US005924628A

United States Patent [19]

Oliff

[11] Patent Number: 5,924,628

[45] Date of Patent: Jul. 20, 1999

[54] INTERLOCKING ARRANGEMENT FOR PANELS HAVING ALIGNMENT TONGUE

[76] Inventor: James R. Oliff, Mead Packaging, P.O. Box 4417, Atlanta, Ga. 30302

[21] Appl. No.: 09/191,758

[22] Filed: Nov. 14, 1998

[51] Int. Cl.[6] ..... B65D 5/42

[52] U.S. Cl. ..... 229/198.2; 206/141; 206/427

[58] Field of Search ..... 229/103.2, 198.2; 206/141, 427

[56] References Cited

U.S. PATENT DOCUMENTS

| | | | |
|---|---|---|---|
| 2,898,028 | 8/1959 | Coe . | |
| 2,901,158 | 8/1959 | Carpino . | |
| 3,027,063 | 3/1962 | Zastrow . | |
| 3,249,284 | 5/1966 | Wood . | |
| 3,705,681 | 12/1972 | Rossi et al. | 229/103.2 |
| 4,498,618 | 2/1985 | Sutherland | 229/198.2 |
| 4,732,316 | 3/1988 | Oliff et al. . | |
| 4,878,612 | 11/1989 | Schuster | 206/427 |
| 5,251,807 | 10/1993 | Capaci . | |
| 5,364,022 | 11/1994 | Ganz | 229/198.2 |
| 5,398,870 | 3/1995 | Bienaime | 229/198.2 |
| 5,443,203 | 8/1995 | Sutherland | 229/198.2 |
| 5,472,138 | 12/1995 | Ingram | 229/198.2 |
| 5,588,586 | 12/1996 | Negelen | 229/198.2 |
| 5,868,308 | 2/1999 | Briand | 229/103.2 |

*Primary Examiner*—Gary E. Elkins

[57] ABSTRACT

An interlocking arrangement for panels comprises first and second panels, a locking tab extending from the first panel, an alignment tongue extending from the distal edge of the locking tab, a second panel, a locking slit defined in the second panel for receiving the locking tab, and an alignment slit defined also in the second panel for receiving the tongue when the locking tab is received in the locking slit. The locking tab has a head defining a widened locking shoulder disposed along at least one of its side edges. The shoulder of the locking tab is designed to engage the locking slit to retain the locking tab within the locking slit. The locking slit is disposed alongside the leading edge of the second panel. The alignment slit is disposed adjacent to the locking slit such that the locking slit is interposed between the alignment slit and the leading edge of the second panel.

20 Claims, 4 Drawing Sheets

INTERLOCKING ARRANGEMENT FOR PANELS HAVING ALIGNMENT TONGUE

BACKGROUND OF THE INVENTION

The present invention relates generally to arrangements for interlocking panels, and more particularly to an interlocking arrangement for panels wherein a tongued locking tab forms a cooperative slide locking engagement with two slits. The present invention also relates to a carton employing the interlocking arrangement for panels.

In the packaging of articles, and particularly of one or more articles in wrap-around type cartons, interlocking arrangements are frequently used for maintaining closure of the carton about the articles. It can be appreciated that such interlocking arrangements must be securely and reliably engaged, and must remain in such condition until the carton is opened.

One well-known form of interlocking arrangement comprises a locking tab and cooperating slit. An example of this type of locking arrangement can be seen in U.S. Pat. No. 3,249,284. In this example, as is typical, the locking tab includes a head portion attached along a relatively narrow neck to a panel of the carton. The tab includes at least one shoulder, i.e., that portion of the tab where the head connects with the relatively narrow neck. On an opposite panel of the carton, a slit is formed into which the tab may be inserted. Following insertion, the tab shoulder engages the end of the slit, preventing the tab from being withdrawn, and thereby securing the lock.

In interlocking arrangements of this type, the length of the slit is equal to or slightly greater than the width of the head portion of the locking tab to allow the tab to be inserted thereinto. As a result, the tab may be laterally movable when it is fully inserted up to its neck. Such lateral movement could result in disengagement of the tab shoulder from the slit. For this reason, it is advantageous to provide means to restrict lateral movement of the locking tab. One way in which the locking tab can be laterally restrained is to arrange a row of locking tabs such that each of the opposite end locking tabs is provided with only one shoulder so that the shoulderless side edge of that tab abuts the adjacent end of the associated slit and thereby restrains all the tabs in the row from lateral movement. An example of such an approach can be seen in U.S. Pat. No. 4,732,316. One disadvantage of this approach, however, is less locking strength of the interlocking arrangement due to the reduction in number of the locking points.

What is needed, therefore, is an improved interlocking arrangement which increases the security of the interlocking arrangement against inadvertent disengagement. Such an arrangement should be capable of restraining the locking tab from moving within the locking slit without reducing the number of the locking points.

SUMMARY OF THE INVENTION

In meeting the foregoing needs, the present invention provides an interlocking arrangement for panels including first and second panels, a locking tab extending from the first panel, an alignment tongue extending from the distal edge of the locking tab, a second panel, a locking slit defined in the second panel for receiving the locking tab, and an alignment slit defined also in the second panel for receiving the tongue when the locking tab is received in the locking slit. The locking tab has a head defining a widened locking shoulder disposed along at least one of its side edges. The shoulder of the locking tab is designed to engage the locking slit when the locking tab is received in the locking slit. The locking slit is disposed alongside the leading edge of the second panel. The alignment slit is disposed adjacent to the locking slit such that the locking slit is interposed between the alignment slit and the leading edge of the second panel.

The alignment tongue when fully received in the alignment slit serves to laterally locate the locking tab at the proper position within the locking slit where the shoulder is securely engaged with the locking slit. In this embodiment, the alignment slit may include a medial portion disposed substantially parallel to the leading edge of the second panel. The medial portion may have a length such that, when the shoulder of the tab is engaged with the locking slit, the opposite ends of the medial portion are located generally on the side edges of the alignment tongue, respectively. More particularly, the alignment tongue may have a maximum width thereacross at its base, which maximum width may be generally equal to the length of the medial portion of the alignment slit. Further, the alignment tongue may have a minimum width along its free edge. Such a minimum width may be less than the length of the medial portion of the alignment slit. The alignment slit may further include a pair of opposite side portions extending from the opposite ends of the medial portion toward the locking slit. The side portions of the alignment slit may be disposed such that, when the shoulder of the locking tab is engaged with the locking slit, the side portions are in general alignment respectively with the side edges of the tongue. The side portions of the alignment slit may be divergent toward the locking slit whereas the side edges of the alignment tongue may be divergent toward the locking tab.

Alternatively, the alignment slit may include a medial portion disposed substantially parallel to the leading edge of the second panel. The medial portion may be disposed such that, when the shoulder of the tab is engaged with the locking slit, the medial portion and the distal edge of the tab are generally collinear.

The second panel may include a main portion and a leading portion defining the leading edge of the second panel. The leading portion may be foldably connected to the main portion along at least one panel fold line. The locking slit may be disposed at least in part in the leading portion while the alignment slit may be disposed in the main portion. The locking slit may have its opposite ends on the panel fold line and the other part in the leading portion of the second panel.

The head of the locking tab may further define a second widened locking shoulder disposed along the other side edge of the head. The shoulders of the locking tab are designed to engage the locking slit to prevent the locking tab from being withdrawn from the locking slit.

The locking tab may further comprise a neck disposed between the shoulder and the first panel. In this embodiment, the locking tab may have a tab fold line extending at least partially thereacross. The tab fold line may be disposed such that the tab fold line defines a boundary between the neck and the head.

Alternatively, the tab fold line may be disposed such that, when the shoulder of the locking tab is engaged with the locking slit, the tab fold line is generally collinear with the panel fold line between the main and leading portions of the second panel.

The locking tab may define a maximum width thereacross at the shoulder. The maximum width may be less than or equal to the length of the locking slit.

The present invention in another aspect provides a carton including first and second overlapping panels and locking means for securing the panels together. The locking means includes a locking tab extending from the first panel, an alignment tongue extending from the distal edge of the locking tab, a locking slit defined in the second panel and receiving the locking tab, and an alignment slit defined in the second panel and receiving the alignment tongue. The locking tab has a head defining a widened locking shoulder disposed along at least one of its side edges. The shoulder of the locking tab engages the locking slit to retain the locking tab within the locking slit. The locking slit is disposed alongside the leading edge of the second panel. The alignment slit is disposed adjacent to the locking slit such that the locking slit is interposed between the alignment slit and the leading edge of the second panel.

In a preferred embodiment, the alignment tongue and the alignment slit in cooperation serve to laterally retain the locking tab at the proper position within the locking slit where the shoulder of the tab is engaged with the locking slit.

Other advantages and objects of the present invention will be apparent from the following description, the accompanying drawings, and the appended claims.

DETAILED DESCRIPTION OF THE PREFERRED EMBODIMENTS

Figure 1:
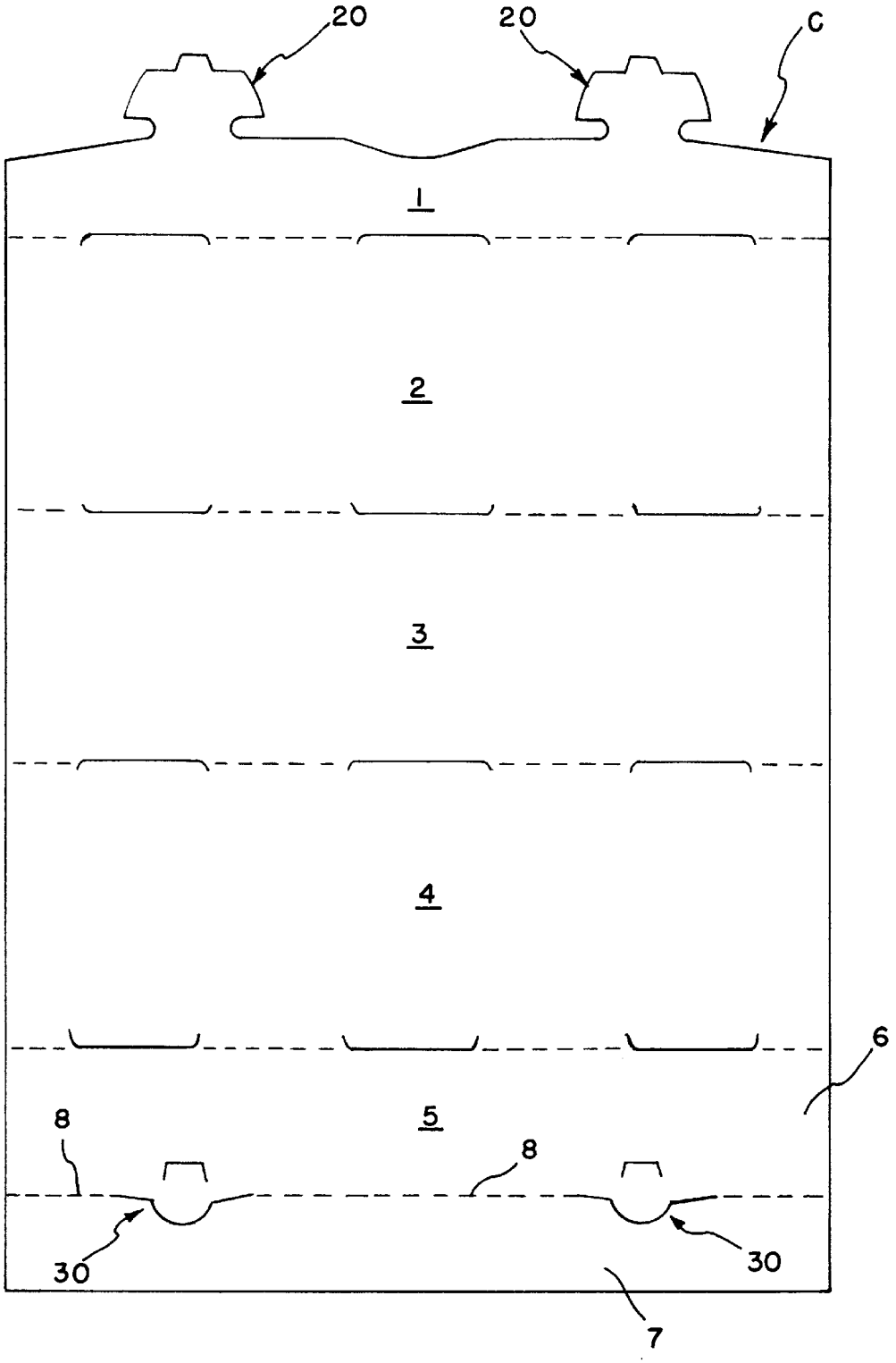
FIG. 1 is a plan view illustration of a carton blank including an interlocking arrangement for panels in accordance with a preferred embodiment of the invention.

Throughout the drawings the same reference numerals are used to denote the same features.

Referring first to FIG. 1, a paperboard carton blank C is illustrated which includes an interlocking arrangement for panels in accordance with a preferred embodiment of the invention. In the illustrated embodiment, the blank C is configured to form a carton of a wrap-around type having closure panels 1 and 5, side wall panels 2 and 4, and a top panel 3. Male locking tabs 20 extend from one of the closure panels 1 while corresponding slit arrangements 30 are formed in the other closure panel 5. The closure panel 5 includes a main panel portion 6 and a leading panel portion 7 connected along a plurality of collinear fold lines 8.

Although the illustrated embodiment includes a carton for forming a relatively simple wrap-around style carton, it will be understood that the interlocking arrangement of the present invention is usable in any carton or other application in which panels of sheet material are to be secured by means of a slide-type lock.

Figure 2:
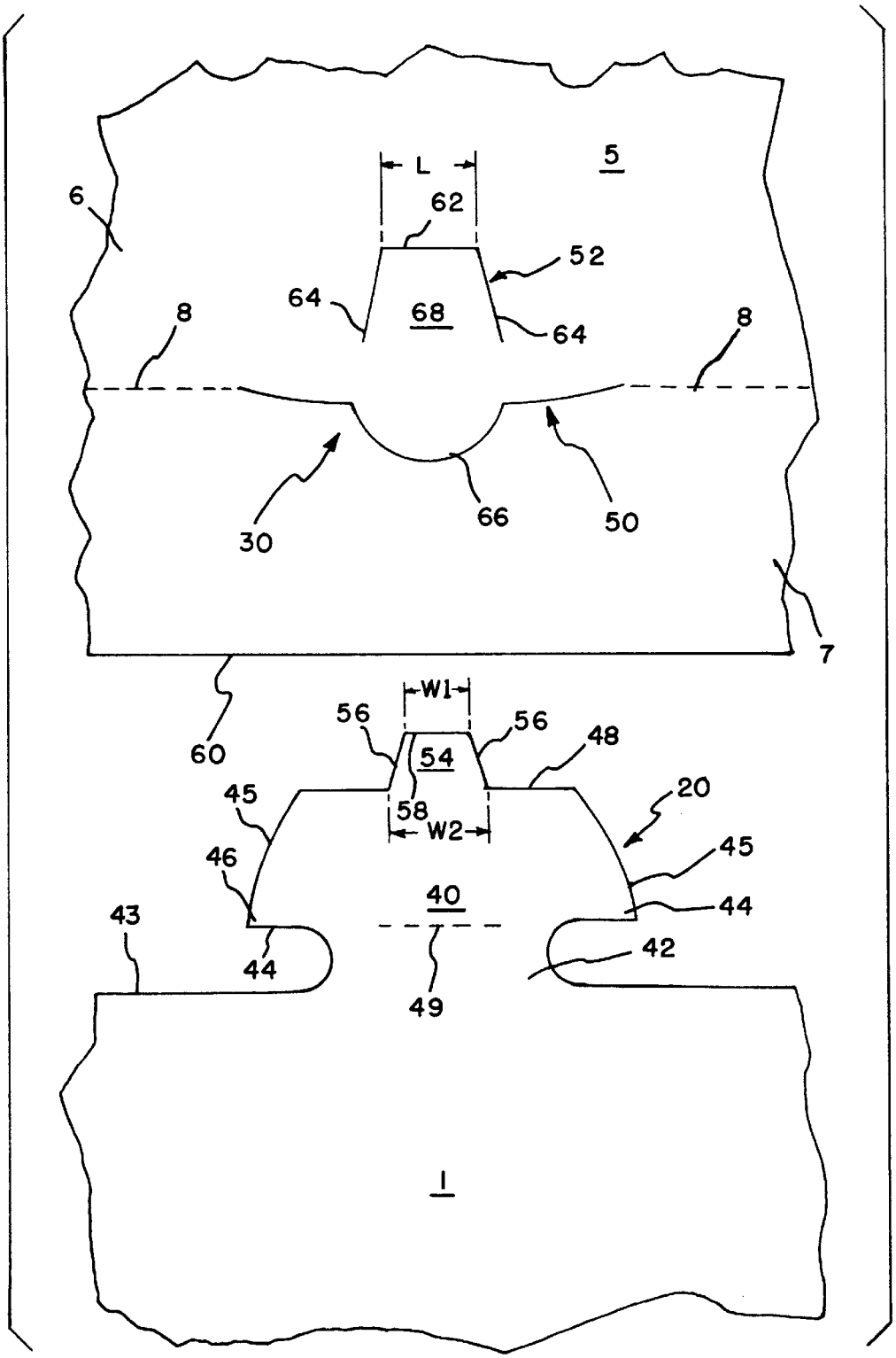
FIG. 2 is a plan view illustration showing enlarged portions of a carton during formation, including the locking arrangement of FIG. 1 positioned for engagement.

The interlocking arrangement of FIG. 1 is shown in greater detail in FIG. 2. A portion of the closure panel 1 is shown, which portion includes one of the locking tabs 20 joined thereto. A portion of the closure panel 5 including the main panel portion 6 and the leading panel portion 7 are also shown, positioned as they would appear during folding of the blank to form the carton, just prior to insertion of the tab 20 into the corresponding slit arrangement 30 located in the closure panel 5.

The locking tab 20 includes a head 40 which is connected to the panel 1 by a relatively narrow neck 42. The head 40 defines widened locking shoulders 46 disposed along its side edges 45. Each shoulder 46 in this embodiment, more particularly, is defined between the respective side edge 45 and the adjacent proximal edge 44. The head 40 also defines a distal edge 48 which in this embodiment is formed generally as a straight edge parallel to the leading edge 43 of the panel 1. The locking tab 20 also includes an alignment tongue 54 extending from the distal edge 48 of the head 40. The tongue 54 in this embodiment has divergent opposite side edges 56 which diverge from each other as extending toward the head 40. This allows the tongue 54 to have a minimum width "W1" along its free edge 58 and a maximum width "W2" at its base. Optionally, a fold line 49 may be formed in the tab 20. The fold line 49 may extend transversely and at least partially across the neck 42, and may be collinear with the proximal edges 44 of the panel 1 so that the fold line 49 defines a boundary between the neck 42 and the head 40.

The slit arrangement 30 comprises a locking slit 50 and an alignment slit 52. The locking slit 50 extends from one of the fold lines 8 at an outward angle into the leading panel portion 7 and turns to another fold line 8 to be terminated thereon. In the preferred embodiment, the intermediate portion of the locking tab 50 is arcuately curved to define a semicircular tab 66, although other configurations may be used for the locking slit 50. Further, the opposite end portions of the locking slit 50 may be extended into the main panel portion 6 rather than being terminated on the fold lines 8.

The alignment slit 52 is formed in the main panel portion 6 adjacent to the locking slit 50 so that the locking slit 50 is interposed between the alignment slit 52 and the leading edge 60 of the panel 5. The slit 52 in this embodiment includes a medial portion 62 and a pair of divergent side portions 64. The medial portion 62 is disposed substantially parallel to the leading edge 60 of the panel 5. The length "L" of the medial portion 62 is substantially greater than the minimum width "W1" of the tongue 54 of the locking tab 20 and is equal to or slightly greater than the maximum width "W2" of the tongue 54. The side portions 64 diverge from each other as extending from the opposite ends of the medial portion 62 toward the locking slit 50. The side portions 64 and the medial portion in cooperation define a trapezoidal tab 68 formed from the main panel portion 6.

For interlocking, after carton blank has been wrapped around the article or articles to be packaged, the panel 1 is positioned with respect to panel 5 as shown generally in FIG. 2. The leading panel portion 7 is folded out of the plane of the main panel portion 6 along fold lines 8. Upon folding of the portion 7, the locking slit 50 will provide an opening beneath the semicircular tab 66. The locking tab 20 is then inserted into the opening. In the process of insertion, the tongue 54 thrusts the trapezoidal tab 68 upwards so that the alignment slit 52 provides a second opening for receiving the tongue 54. The side portions 64 of the slit 52 will interact with the side edges 56 of the tongue 54 to guide the insertion of the tongue 54 into the second opening. By this means, the tongue 54 is finally disposed within the medial portion 62 of the slit 52 with the tab 20 being inserted sufficiently far into the locking slit 50 to cause the shoulders 46 to be captured by the opposite end portions of the locking slit 50. This condition is illustrated in FIG. 3 in which the captured shoulders 46 prevent the tab 20 from being withdrawn from the locking slit 50.

Figure 3:
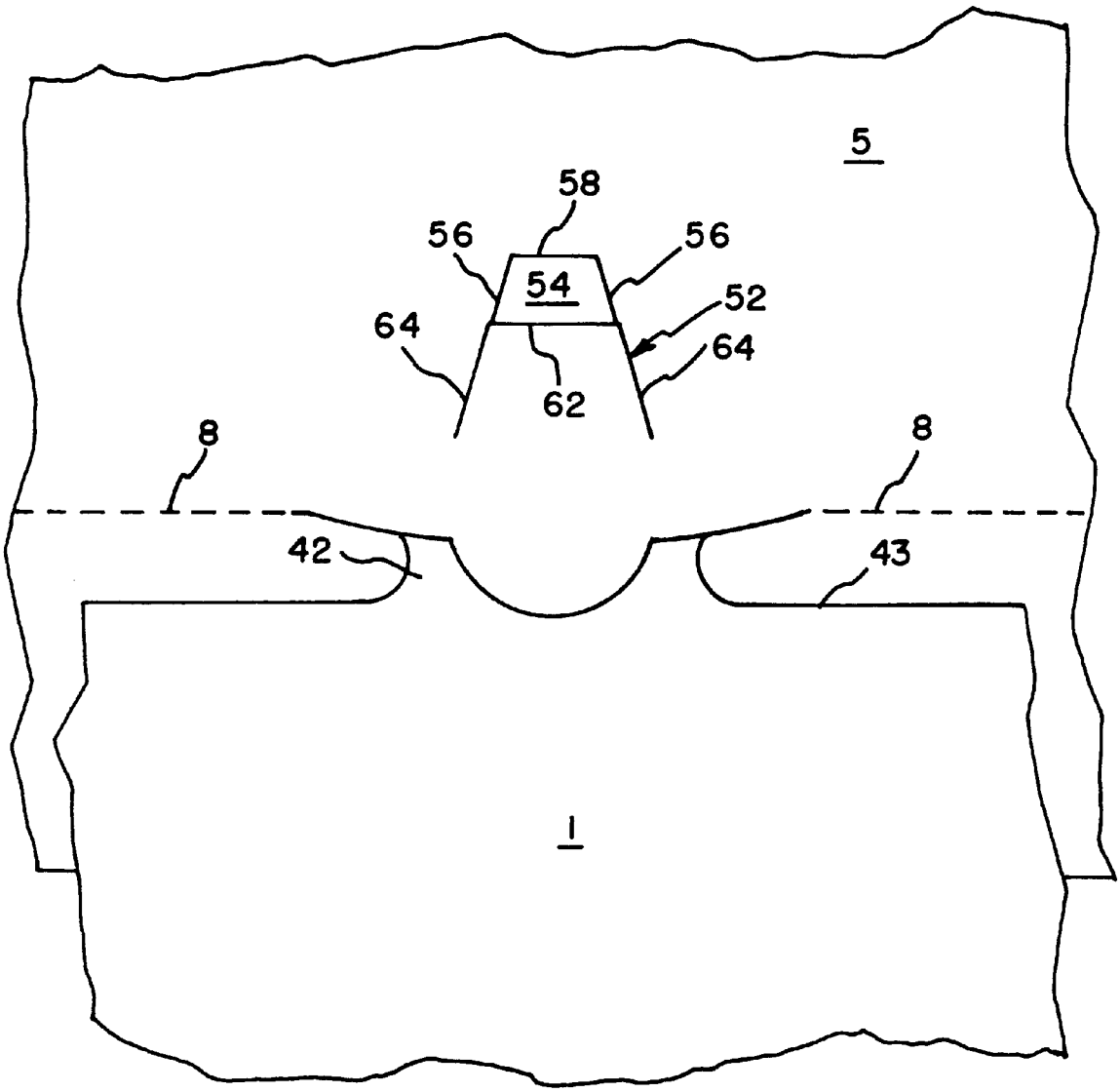
FIG. 3 is plan view similar to FIG. 2, showing the carton portions following engagement of the interlocking arrangement.

One advantage of the interlocking arrangement of the present invention can be appreciated from the illustration of FIG. 3. In the engaged condition, the side edges 56 of the alignment tongue 54 are generally collinear with and thus positioned against the side portions 64 (or the opposite ends of the medial portion 62) of the alignment slit 52, respectively. As a result, the locking tab 20 is laterally located at the position within the locking slit 50 where the shoulders 46 are properly engaged with the locking slit 50, and is restrained from lateral movement. This is advantageous in that because the locking tab 20 is laterally retained in position, the shoulders 46 of the head 40 are maintained in locking engagement with the slit 50, thereby increasing the security of the interlocking arrangement against inadvertent disengagement.

Another advantage of the interlocking arrangement of the invention is that, in the engaged condition, the distal edge 48 of the tab 20 will be generally collinear with the medial portion 62 of the slit 52. In other words, the locking tab 20 can be inserted only till the distal edge 48 of the tab 20 abuts the medial portion 62 of the alignment slit 52. This prevents overtightening of the blank around the package contents, which can damage the carton blank or its contents.

Figure 4:
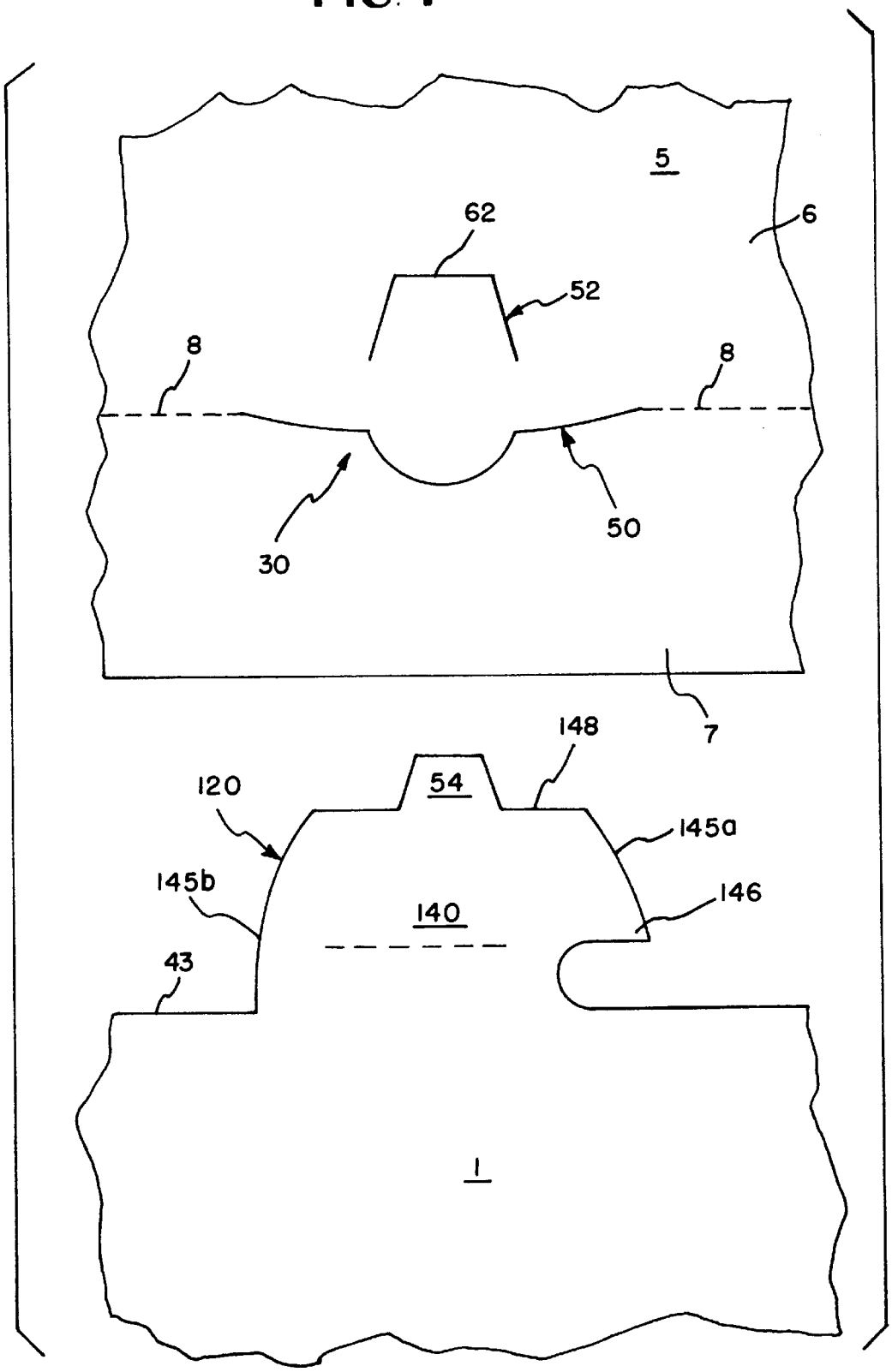
FIG. 4 is a view similar to FIG. 2, showing an alternative embodiment for the interlocking arrangement of the present invention.

The embodiment of FIG. 4 illustrates an alternative locking tab 120. The slit arrangement 30 used in this embodiment is virtually identical to that in the embodiment of FIGS. 1–3. Unlike the embodiment of FIGS. 1–3, The locking tab 120 does not have two shoulders, but rather has one shoulder 146 on the side edge 145*a* of the head 140. The other side edge 145*b* of the head 140 is smooth and extends from the distal edge 148 of the head 140 to the leading edge 43 of the panel 1 without interruption. Nonetheless, it will be recognized that because the alignment tongue 54 is to be disposed within the medial portion 62 of the slit 52, the tab 120 will be laterally and longitudinally retained at the position where the shoulder 146 properly engages the locking slit 50. The smooth side edge 145*b* of the locking tab 120 will abuts the adjacent end of the locking slit 50 and will thereby assists in restraining lateral movement of the tab 120.

It will be appreciated that still further alternative embodiments of the present invention are possible. For example, it is not necessary that the alignment slit 52 include the medial and side portions. Instead, the alignment slit may have the shape of an arch or bow. In such an embodiment, the distance between the opposite ends of the arched alignment slit may be equal to or slightly greater than the maximum width "W2" of the tongue 54. The shape of the alignment tongue may also be varied. An alternative tongue may have a rounded or arched boundary rather than the cornered boundary as shown in the attached drawings.

It will further be recognized that the neck 42 may be varied depending upon the relative size of the locking tab 20, the carton and the panels which comprise the carton. For example, the neck 42 may be made longer or shorter than depicted in FIGS. 1–3, thereby changing the distance by which the head 40 of the locking tab 20 is spaced from the leading edge 43 of the panel 1. Indeed, the neck 42 may be formed to have no length at all, in which case the shoulders 46 will be disposed immediately adjacent the leading edge 43 of the panel 1.

It is further noted that although the panels 1 and 5 upon which the elements of the interlocking arrangement are illustrated may be considered as bottom panels of the carton shown, use of the interlocking arrangement with panels that ultimately serve as top, side, end or other panels that form a closure is encompassed by and within the scope and spirit of the invention.

What is claimed is:

1. An interlocking arrangement for panels comprising:

a first panel;

a locking tab extending from said first panel, said tab having a head having a distal edge and a pair of opposite side edges, said head defining a widened locking shoulder disposed along at least one of said side edges;

an alignment tongue extending from said distal edge of said tab;

a second panel having a leading edge;

a locking slit defined in said second panel for receiving said tab and engaging said shoulder of said tab, said locking slit being disposed alongside said leading edge of said second panel; and an alignment slit defined in said second panel for receiving said tongue when said tab is received in said locking slit, said alignment slit being disposed adjacent to said locking slit such that said locking slit is interposed between said alignment slit and said leading edge of said second panel.

2. The interlocking arrangement according to claim 1, wherein said alignment tongue when fully received in said alignment slit provides means for laterally locating said tab at a position within said locking slit where said shoulder is engaged with said locking slit.

3. The interlocking arrangement according to claim 2, wherein said alignment tongue has opposite side edges, and said alignment slit includes a medial portion disposed substantially parallel to said leading edge of said second panel, said medial portion having a length such that, when said shoulder of said tab is engaged with said locking slit, opposite ends of said medial portion are generally placed on said side edges of said tongue, respectively.

4. The interlocking arrangement according to claim 3, wherein said alignment tongue has a free edge extending between said side edges thereof, and said tongue has a minimum width along said free edge, said minimum width being less than said length of said medial portion of said alignment slit.

5. The interlocking arrangement according to claim 3, wherein said alignment tongue has a maximum width thereacross at a base thereof, said maximum width being generally equal to said length of said medial portion of said alignment slit.

6. The interlocking arrangement according to claim 3, wherein said alignment slit further includes a pair of opposite side portions extending from said opposite ends of said medial portion toward said locking slit, and said side portions of said alignment slit are disposed such that, when said shoulder of said tab is engaged with said locking slit, said side portions are generally collinear with said side edges of said tongue, respectively.

7. The interlocking arrangement according to claim 6, wherein said side portions of said alignment slit are divergent toward said locking slit, and said side edges of said tongue are divergent toward said tab.

8. The interlocking arrangement according to claim 1, wherein said alignment slit includes a medial portion disposed substantially parallel to said leading edge of said second panel, said medial portion being disposed such that, when said shoulder of said tab is engaged with said locking slit, said medial portion and said distal edge of said tab are generally collinear.

9. The interlocking arrangement according to claim 1, wherein said second panel comprises a main portion and a leading portion defining said leading edge of said second panel, said leading portion being foldably connected to said main portion along at least one panel fold line, said locking slit is disposed at least in part in said leading portion and said alignment slit is disposed in said main portion.

10. The interlocking arrangement according to claim 9, wherein said locking slit having opposite ends disposed on said panel fold line and the other part in said leading portion of said second panel.

11. The interlocking arrangement according to claim 1, wherein said head of said locking tab further defines a second widened locking shoulder disposed along the other side edge of said head, said shoulders engaging said locking slits to retain said tab within said locking slit.

12. The interlocking arrangement according to claim 1, wherein said tab further comprises a neck disposed between said shoulder and said first panel.

13. The interlocking arrangement according to claim 12, said tab has a tab fold line extending at least partially thereacross, said tab fold line being disposed such that said tab fold line defines a boundary between said neck and said head.

14. The interlocking arrangement according to claim 9, said tab has a tab fold line extending at least partially thereacross, said tab fold line being disposed such that, when said shoulder of said tab is engaged with said locking slit, said tab fold line is generally collinear with said panel fold line.

15. The interlocking arrangement according to claim 1, wherein said locking tab defines a maximum width thereacross at said shoulder, said maximum width being less than or equal to the length of said locking slit.

16. A carton comprising first and second overlapping panels and locking means for securing said panels together, said locking means comprising:

a locking tab extending from said first panel, said tab having a head having a distal edge and a pair of opposite side edges, said head defining a widened locking shoulder disposed along at least one of said side edges;

an alignment tongue extending from said distal edge of said tab;

a locking slit defined in said second panel and receiving said tab, said shoulder of said tab engaging said locking slit to retain said tab within said locking slit, said locking slit being disposed alongside a leading edge of said second panel; and an alignment slit defined in said second panel and receiving said tongue, said alignment slit being disposed adjacent to said locking slit such that said locking slit is interposed between said alignment slit and said leading edge of said second panel.

17. The carton according to claim 16, wherein said tongue and said alignment slit in cooperation provide means for laterally retaining said tab at a position within said locking slit where said shoulder is engaged with said locking slit.

18. The carton according to claim 17, wherein said alignment tongue has a pair of opposite side edges, and said alignment slit includes a medial portion disposed substantially parallel to said leading edge of said second panel, and said medial portion having a length such that opposite ends of said medial portion are in general alignment respectively with said side edges of said tongue.

19. The carton according to claim 18, wherein said alignment slit further includes a pair of opposite side portions extending from said opposite ends of said medial portion toward said locking slit, and said side portions of said alignment slit are disposed such that said side portions are in general alignment respectively with said side edges of said tongue.

20. The carton according to claim 16, wherein said alignment slit includes a medial portion disposed substantially parallel to said leading edge of said second panel, said medial portion being disposed such that said medial portion and said distal edge of said tab are generally collinear.

* * * * *